US009415322B2

(12) United States Patent
Kanauchi

(10) Patent No.: US 9,415,322 B2
(45) Date of Patent: Aug. 16, 2016

(54) COMBINABLE TRANSFORMABLE TOY

(71) Applicant: ING21 CO., LTD., Tokyo (JP)

(72) Inventor: Shigeru Kanauchi, Tokyo (JP)

(73) Assignee: ING21 CO., LTD., Tokyo (JP)

( * ) Notice: Subject to any disclaimer, the term of this patent is extended or adjusted under 35 U.S.C. 154(b) by 0 days.

(21) Appl. No.: 14/661,741

(22) Filed: Mar. 18, 2015

(65) Prior Publication Data

US 2015/0352457 A1 Dec. 10, 2015

(30) Foreign Application Priority Data

Jun. 5, 2014 (JP) ..... 2014-002956 U

(51) Int. Cl.

| | |
|---|---|
| ***A63H 3/12*** | (2006.01) |
| ***A63H 33/00*** | (2006.01) |
| ***A63H 3/00*** | (2006.01) |
| ***A63H 3/52*** | (2006.01) |

(52) U.S. Cl.

CPC ..... *A63H 33/003* (2013.01); *A63H 3/00* (2013.01); *A63H 3/52* (2013.01)

(58) Field of Classification Search

USPC ..... 446/72, 94, 95, 97, 98, 102, 319, 320, 446/321, 330, 337, 339

See application file for complete search history.

(56) References Cited

U.S. PATENT DOCUMENTS

| | | | | |
|---|---|---|---|---|
| 4,516,948 | A * | 5/1985 | Obara | A63H 33/003 446/376 |
| 4,580,992 | A * | 4/1986 | McKay | A63H 3/12 446/321 |
| 4,639,233 | A * | 1/1987 | Brassfield | A63H 3/12 446/321 |
| 5,310,379 | A * | 5/1994 | Hippely | A63H 33/003 446/279 |
| 6,648,721 | B2 * | 11/2003 | Rehkemper | A63H 3/00 446/268 |
| 6,758,717 | B1 * | 7/2004 | Park | A63H 3/365 446/321 |
| 8,348,715 | B2 * | 1/2013 | Miyake | A63H 17/02 446/321 |
| 8,784,153 | B2 * | 7/2014 | Sugimoto | A63H 33/003 273/142 R |
| 2009/0227175 | A1 * | 9/2009 | Hasui | A63H 33/003 446/268 |
| 2012/0142249 | A1 * | 6/2012 | Chan | A63H 3/28 446/321 |

FOREIGN PATENT DOCUMENTS

JP S63-56078 U 4/1988

* cited by examiner

*Primary Examiner* — Kurt Fernstrom
(74) *Attorney, Agent, or Firm* — Oliff PLC

(57) ABSTRACT

A combinable transformable toy is provided with a doll body and a mounting body which can be externally mounted on the doll body. The mounting body is provided with a base portion in which an insertion port is opened, a movement portion which is provided to be movable relatively to the base portion, and transformation portions which are coupled to the movement portion. When a head portion of the doll body is inserted from the insertion port, the movement portion is pushed by the doll body to move together with the doll body so that the transformation portions can be transformed in conjunction with the movement of the movement portion. Thus when a mounting body is attached to a doll body, the doll body can change in appearance and the mounting body can be transformed in conjunction with the attachment operation.

6 Claims, 9 Drawing Sheets

20
11
22
22a
12
24
26
31
25
27
28
29
13

COMBINABLE TRANSFORMABLE TOY

BACKGROUND OF THE INVENTION

1. Field of the Invention

The present invention relates to a combinable transformable toy in which a mounting body as an imitation of a dress etc. can be attached to a doll body for playing.

2. Description of the Background Art

According to the background art, there have been known toys each of which is designed to be provided with a doll body and a dress-up member so that a trunk portion of the doll body can be covered with the dress-up member. For example, JP-UM-A-63-56078 discloses a transformable doll toy which is designed in such a manner that a dress-up member is attracted to a doll body by a magnetic substance. According to such a toy, the dress-up member can be mounted on the doll body so that the doll body can be transformed easily.

However, in the aforementioned background-art toy, the dress-up member is mounted as it is. For this reason, there has been a demand for toys richer in unexpectedness.

SUMMARY OF THE INVENTION

Therefore, an object of the present invention is to provide a combinable transformable toy in which when a mounting body is attached to a doll body for playing, not only can the doll body change in appearance but also the mounting body can be transformed in conjunction with the attachment operation.

The present invention has been accomplished in order to solve the foregoing problem. The invention has the following characteristics.

According to a first configuration of the invention, there is provided a combinable transformable toy including: a doll body; and a mounting body which can be externally mounted on the doll body; wherein: the mounting body is provided with a base portion in which an insertion port is opened, a movement portion which is provided to be movable relatively to the base portion, and a transformation portion which is coupled to the movement portion; and when a head portion of the doll body is inserted from the insertion port, the movement portion is pushed by the doll body to move together with the doll body so that the transformation portion can be transformed in conjunction with the movement of the movement portion.

According to a second configuration of the invention, the mounting body covers the doll body while exposing a face of the doll body.

According to a third configuration of the invention, the movement portion is attached to the base portion slidably.

According to a fourth configuration of the invention, the transformation portion is urged in an opening direction by a spring but locked against urging force of the spring in a state prior to transformation so that when the movement portion moves, the transformation portion can be unlocked and transformed.

According to a fifth configuration of the invention, the transformation portion is made of a soft material, and folded and received inside the base portion or the movement portion in a state prior to transformation.

According to the first configuration of the invention as described above, when the head portion of the doll body is inserted from the insertion port of the mounting body, the movement portion of the mounting body is pushed by the doll body to move together with the doll body so that the transformation portion can be transformed in conjunction with the movement of the movement portion. That is, when the mounting body is attached to the doll body for playing, not only can the doll body change in appearance but also the mounting body can be transformed in conjunction with the attachment operation. Accordingly, the combinable transformable toy can be made rich in unexpectedness.

In addition, according to the second configuration of the invention as described above, the mounting body covers the doll body while exposing the face of the doll body. Accordingly, the combinable transformable toy can be made to provide a way to be played as a dress-up toy.

In addition, according to the third configuration of the invention as described above, the movement portion is attached to the base portion slidably. That is, when the movement portion slides against the base portion, the mounting body is transformed with mechanical movement. Accordingly, the structure can be made suitable for a toy for boys such as a transformable robot.

In addition, according to the fourth configuration of the invention as described above, the transformation portion is urged in the opening direction by the spring but locked against the urging force of the spring in the state prior to transformation so that when the movement portion moves, the transformation portion can be unlocked and transformed. Accordingly, the mounting body can be transformed in a comparatively simple structure.

In addition, according to the fifth configuration of the invention, as described above, the transformation portion is made of the soft material, and folded and received inside the base portion or the movement portion in the state prior to transformation. According to such a configuration, transformation can be completed when the folded transformation portion is simply pulled out. In this manner, the structure can be made simple. In addition, since the transformation portion is made of the soft material, for example, a soft image can be given to the toy to thereby make it suitable for girls.

DETAILED DESCRIPTION OF THE INVENTION

First Embodiment

A first embodiment will be described with reference to FIGS. 1 to 3, FIGS. 4A to 4E and FIGS. 5A to 5E.

Figure 1:
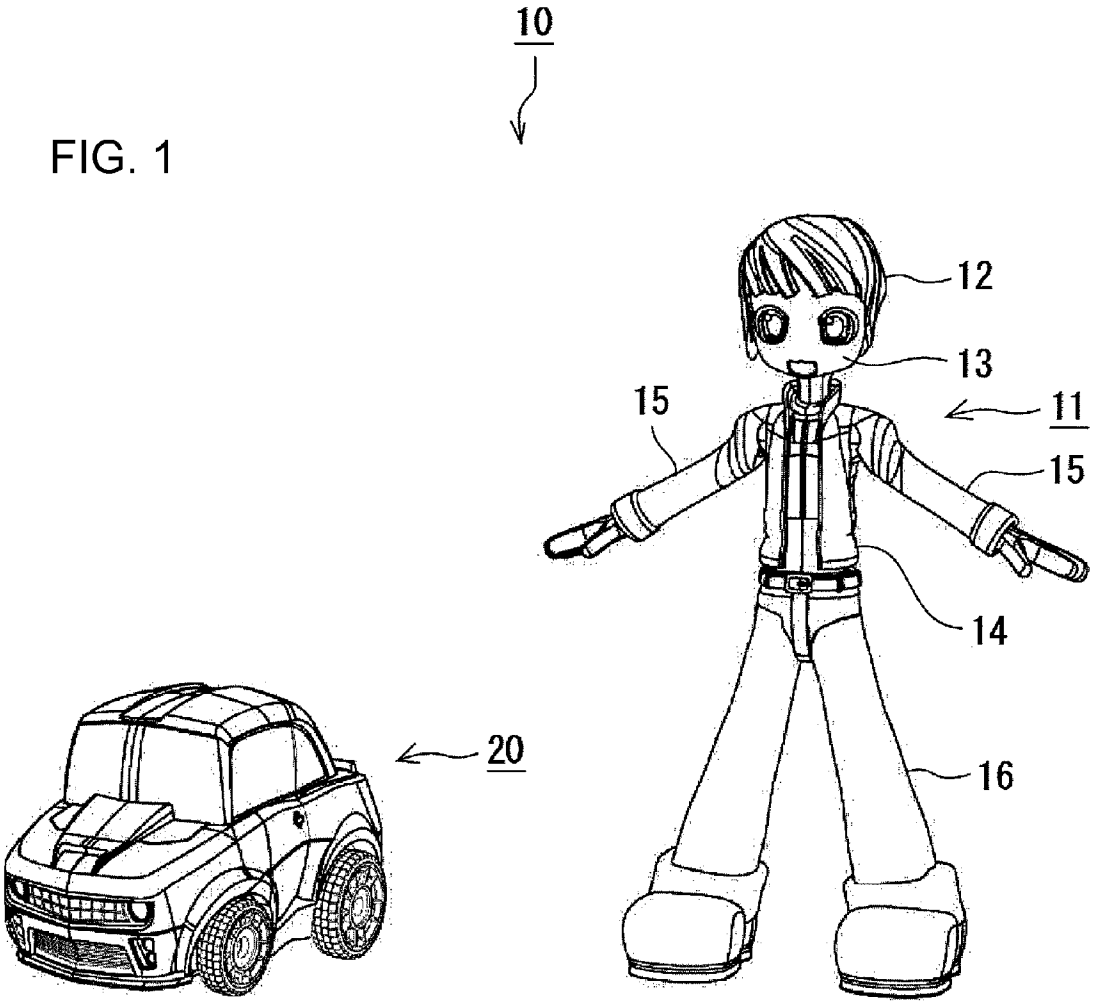
FIG. 1 is an external perspective view of a combinable transformable toy according to a first embodiment.

As shown in FIG. 1, a combinable transformable toy 10 according to the embodiment is configured of a doll body 11 and a mounting body 20.

The doll body 11 is formed as an imitation of a human figure. For example, the doll body 11 is made of a material having certain hardness such as plastic. As shown in FIG. 1, the doll body 11 is provided with a head portion 12, a trunk portion 14, arm portions 15, and leg portions 16. In the embodiment, the head portion 12, the truck portion 14 and the leg portions 16 are connected integrally and immovably. On the other hand, the arm portions 15 are coupled to the trunk portion 14 swingably. Each of the arm portions 15 can swing in a closing direction (direction along the trunk portion 14) in the state shown in FIG. 1. Incidentally, the doll body 11 is not limited to the imitation of the human figure but may be an imitation of any other living thing such as an animal or a non-living character (such as a personified non-living thing or a robot).

The mounting body 20 is a member which is formed to be able to be externally mounted on the doll body 11. The mounting body 20 has the following configuration. That is, the mounting body 20 has a form irrelevant to a dress for the doll body 11 before the mounting body 20 is mounted on the doll body 11. However, after the mounting body 20 is mounted on the doll body 11, the mounting boy 20 is transformed into the form of a dress for the doll body 11. In the embodiment, the mounting body 20 in the state of not being mounted on the doll body 11 has the form of a car. Incidentally, the form of the mounting body 20 prior to transformation is not limited to the car, but can be set as anything such as another vehicle, an animal, a plant or food.

Figure 2:
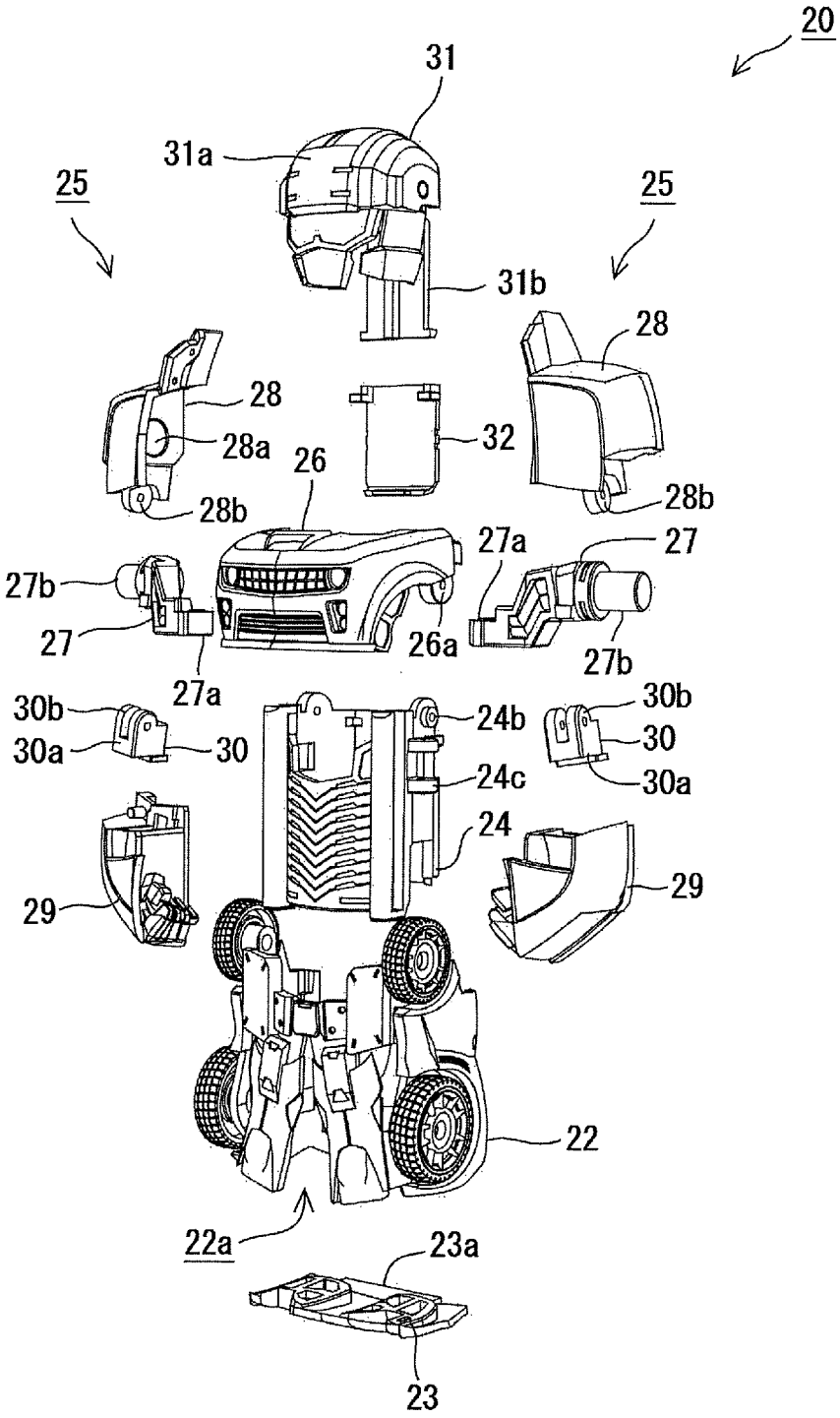
FIG. 2 is an exploded perspective view of a mounting body according to the first embodiment when seen obliquely from the front.
Figure 3:
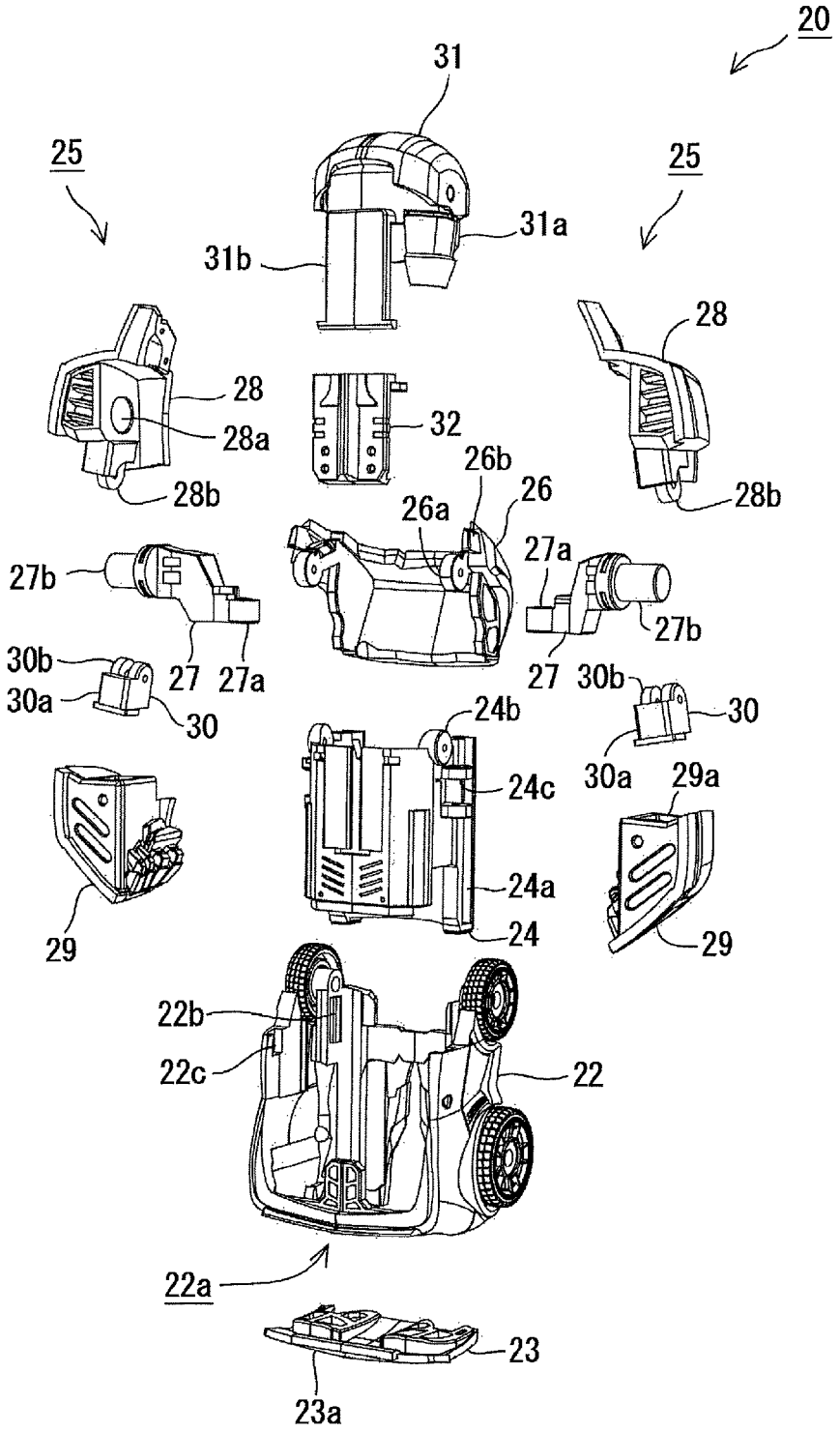
FIG. 3 is an exploded perspective view of the mounting body according to the first embodiment when seen obliquely from the back.

As shown in FIGS. 2 and 3, the mounting body 20 according to the embodiment is provided with a base portion 22, a movement portion, and a transformation portion.

The base portion 22 is a portion which covers the leg portions 16 of the doll body 11 when the mounting body 20 is mounted on the doll body 11. To mount the mounting body 20 on the doll body 11, the base portion 22 is held by a hand and then put on the doll body 11. In this manner, the mounting body 20 can be mounted on the doll body 11. An insertion port 22*a* into which the doll body 11 can be inserted is opened in the base portion 22.

A lid member 23 for covering the insertion port 22*a* is attached to the base portion 22 according to the embodiment. The lid member 23 according to the embodiment is a member made of a soft material (such as rubber) and a fixation portion 23*a* provided at a part of a rim of the lid member 23 is fixed to the base portion 22. The lid member 23 is pushed into the insertion port 22*a* when the doll body 11 is inserted from the insertion port 22*a*.

The movement portion is a portion which is attached to the base portion 22 slidably. The movement portion according to the embodiment includes a slide member 24 and a head member 31.

The slide member 24 is a portion which covers the trunk portion 14 of the doll body 11 when the mounting portion 20 is mounted on the doll body 11. The slide member 24 is provided with slide grooves 24*a* on its opposite sides. When the slide grooves 24*a* are engaged with engagement protrusions 22*b* formed on the inner sides of the base portion 22, the slide member 24 can be guided slidably on the base portion 22. When the doll body 11 is inserted from the insertion port 22*a* to push the lid member 23 into the insertion port 22*a*, the slide member 24 is pushed to slide into the depth of the insertion port 22*a* by the lid member 23. The slide member 24 is provided with upper support portions 24*b* and side support portions 24*c* on its opposite sides. The upper support portions 24*b* serve for supporting a front member 26 rotatably. The front member 26 will be described later. The side support portions 24*c* serve for supporting upper arm members 27 rotatably. The upper arm members 27 will be described later.

The head member 31 is a portion which covers the head portion 12 of the doll body 11 when the mounting body 20 is mounted on the doll body 11. The head member 31 is attached to the slide member 24 slidably. Specifically, the head member 31 is provided with a head covering portion 31*a* and a slide portion 31*b*. The head covering portion 31*a* covers the head portion 12 of the doll body 11. The slide portion 31*b* is provided at the rear of the head covering portion 31*a* so as to hang down therefrom. The slide portion 31*b* is guided slidably along the rear surface of the slide member 24. Incidentally, the slide portion 31*b* is covered with a cover member 32 fixed to the rear surface of the slide member 24. The slide member 31*b* is interposed between the cover member 32 and the slide member 24 so that the slide member 31*b* can be held slidably on the slide member 24. In this manner, the head member 31 supported by the cover member 32 and the side member 24 slidably is pushed to slide onto the head portion 12 of the doll body 11 when the doll body 11 is mounted into the mounting body 20.

The transformation portion is a portion which is coupled to the slide member 24 (movement portion). The transformation portion is a portion which is transformed in conjunction with movement of the slide member 24 when the mounting body 20 is mounted on the doll body 11. The transformation portion according to the embodiment is provided with the front member 26 and a pair of arm portions 25.

The front member 26 is a member which constitutes a front portion of the form of the car. The front member 26 is a member which is located in the vicinity of a chest portion of the doll body 11 when the mounting body 20 is mounted on the doll body 11. The front member 26 is provided with rotatable engagement portions 26*a* engaged with the upper support portions 24*b* of the slide member 24 rotatably. The front member 26 can rotate with respect to the slide member 24 and around the rotatable engagement portions 26*a*. The front member 26 is urged in an opening direction by springs (not shown) but locked against the urging forces of the springs in the state of the car prior to transformation. Specifically, in the state of the car prior to transformation, the front member 26 has a configuration in which locked portions 26*b* of the front member 26 are engaged with locking portions 22*c* provided as recesses in the base portion 22 so that the front member 26 can keep its closed state against the urging forces of the springs. When the slide member 24 moves upward in the state of the car prior to transformation, the front member 26 also moves upward integrally therewith. Thus, the engagement between the locking portions 22*c* and the locked portions 26*b* can be released. When the engagement between the locking portions 22*c* and the locked portions 26*b* is released, the front member 26 rotates frontward due to the urging forces of the springs so as to be transformed.

The arm portions 25 are members which are located in the vicinities of the arm portions 15 of the doll body 11 when the mounting body 20 is mounted on the doll body 11. Each of the left and right arm portions 25 is provided with an upper arm member 27, a shoulder member 28, a lower arm member 29, and a coupling member 30.

The upper arm member 27 is provided with a rotatable engagement portion 27*a* which is engaged with the side support portion 24*c* of the slide member 24 rotatably. The upper arm member 27 can be rotated with respect to the slide member 24 and around the rotatable engagement portion 27*a*. The upper arm member 27 is urged in an opening direction by the spring (not shown) but locked against the urging force of the spring in the state of the car prior to transformation. Specifically, in the state of the car prior to transformation, the upper arm member 27 has a configuration in which the upper arm member 27 folded in the closing direction enters the slide member 24 so that the upper arm member 27 can keep its closed state against the urging force of the spring. When the slide member 24 moves upward in the state of the car prior to transformation, the upper arm member 27 also moves upward integrally therewith to leave the slide member 24. Thus, the engagement between the slide member 24 and the upper arm member 27 can be released. When the engagement between the upper arm member 27 and the slide member 24 is released, the upper member 27 rotates sideways due to the urging force of the spring so as to be transformed.

The shoulder member 28 is a member which is fixed to the upper arm member 27. The shoulder member 28 is provided with an insertion hole 28*a* into which an insertion protrusion 27*b* of the upper arm member 27 is inserted and connected. In addition, the shoulder member 28 is also provided with a rotatable support portion 28*b* on which the coupling member 30 is supported rotatably.

The lower arm member 29 is a member which is provided in a distal end of the arm portion 25. The lower arm member 29 is connected to the shoulder member 28 rotatably and slidably through the coupling member 30 which will be described later. The lower arm member 29 is provided with a slide hole 29*a* into which the coupling member 30 is inserted.

The coupling member 30 is a member for coupling the shoulder member 28 and the lower arm member 29 to each other. The coupling member 30 is provided with a prismatic insertion portion 30*a* which is inserted into the slide hole 29*a* of the lower arm member 29, and a rotation portion 30*b* which is formed in an end portion of the insertion portion 30*a*. The insertion portion 30*a* is inserted into the slide hole 29*a* slidably. The insertion portion 30*a* is formed so that the arm can be extended when the insertion portion 30*a* is pulled out by a hand. When the arm is extended, the coupling member 30 and the lower arm member 29 can be rotated with respect to the shoulder member 28 due to the rotation portion 30*b*.

Next, motion when the doll body 11 is mounted into the mounting body 20 will be described with reference to FIGS. 4A to 4E and FIGS. 5A to 5E.

First, as shown in FIGS. 4A and 4B and FIGS. 5A and 5B, the head portion 12 of the doll body 11 is inserted from the insertion port 22*a*.

When the head portion 12 of the doll body 11 is inserted in the mounting body 20, the slide member 24 and the head member 31 are pushed by the doll body 11 to move upward together with the doll body 11, as shown in FIGS. 4C and 4D and FIGS. 5C and 5D. When the slide member 24 moves upward, the engagement which restrains the front member 26 from rotating is released. Therefore, the front member 26 rotates frontward due to the urging forces of the springs. Similarly, when the slide member 24 moves upward, the engagement which restrains the upper arm members 27 (arm portions 25) from rotating is released. Therefore, the upper arm members 27 (arm portions 25) rotate frontward due to the urging forces of the springs.

Figures 4A, 4B, 4C, 4D, 4E:
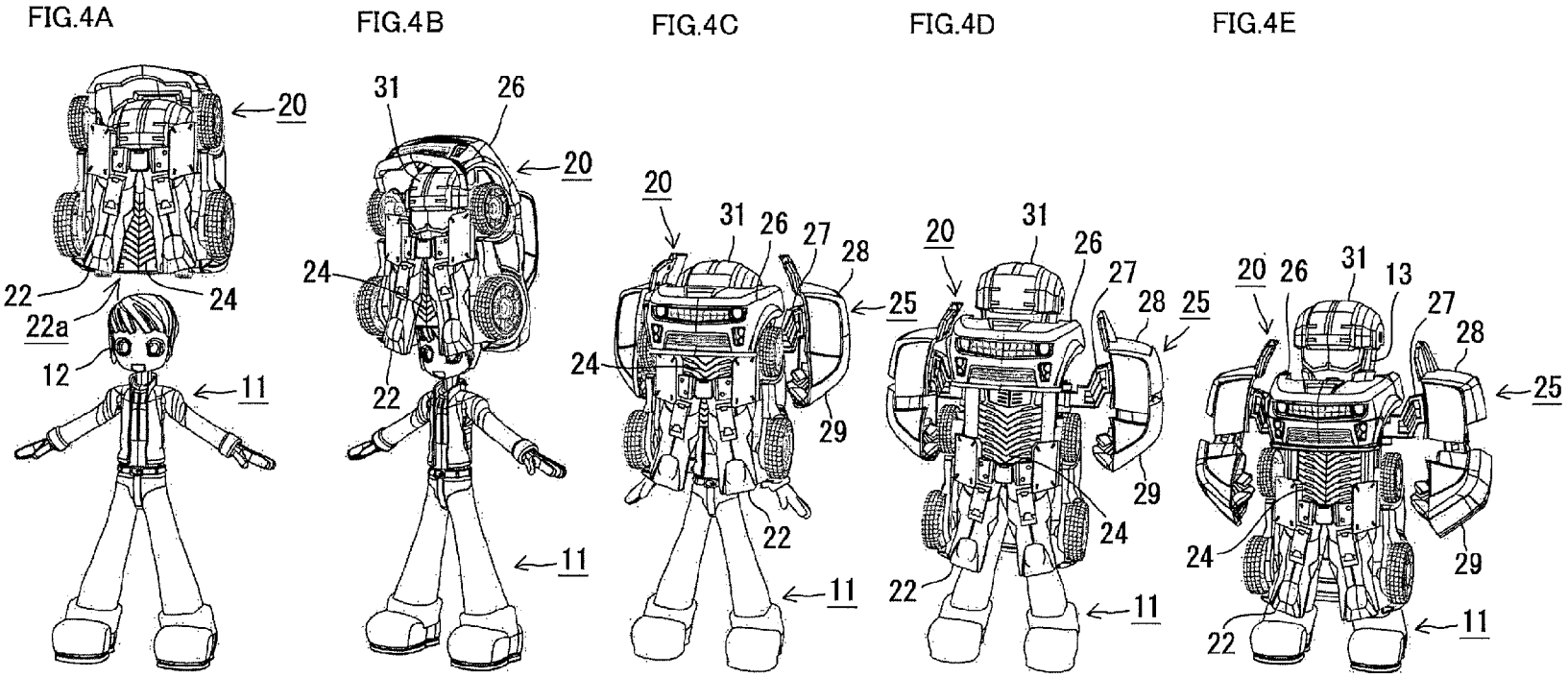
FIGS. 4A to 4E are explanatory views of states in which the mounting body is mounted on a doll body according to the first embodiment when seen obliquely from the front.
Figure 5A:
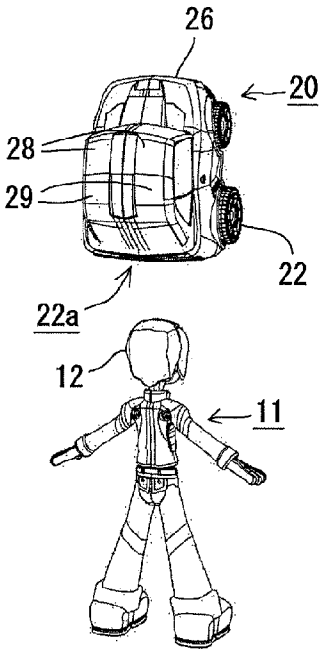
FIGS. 5A to 5E are explanatory views of the states in which the mounting body is mounted on the doll body according to the first embodiment when seen obliquely from the back.
Figure 5B:
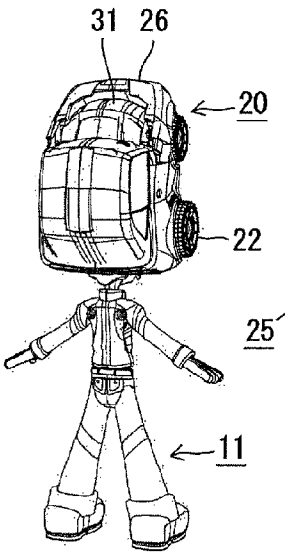
Figure 5C:
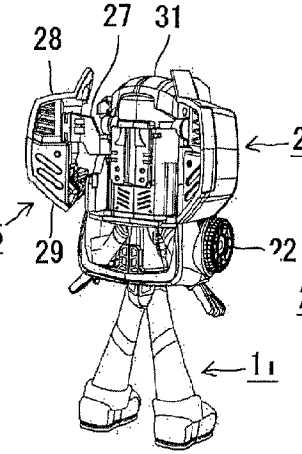
Figure 5D:
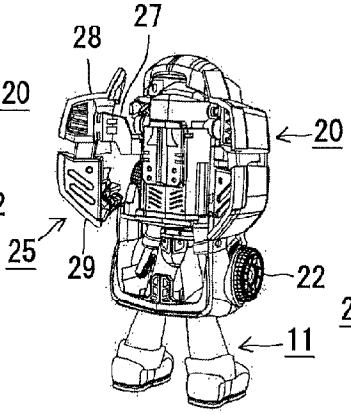
Figure 5E:
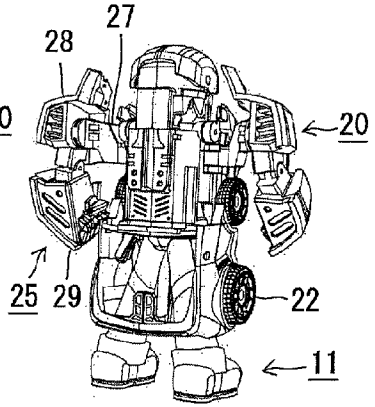

Finally, as shown in FIG. 4E and FIG. 5E, the mounting body 20 is transformed into the form of a robot type suit to cover the doll body 11. On this occasion, the mounting body 20 covers the doll body 11 while exposing a face 13 of the doll body 11. Incidentally, in the state posterior to transformation, the arm portions 15 of the doll body 11 swing in the closing direction so as to be received together with the trunk portion 14 inside the base portion 22 and the slide member 24.

According to such an embodiment, when the head portion 12 of the doll body 11 is inserted from the insertion port 22*a* of the mounting body 20, the slide member 24 of the mounting body 20 is pushed by the doll body 11 to move together with the doll body 11 so that the arm portions 25 and the front member 26 can be transformed in conjunction with the movement of the slide member 24. That is, when the mounting body 20 is attached to the doll body 11 for playing, not only can the doll body 11 change in appearance but also the mounting body 20 can be transformed in conjunction with the attachment operation. Accordingly, the combinable transformable toy 10 can be made rich in unexpectedness.

In addition, the mounting body 20 covers the doll body 11 while exposing the face 13 of the doll body 11. Accordingly, the combinable transformable toy 10 can be made to provide a way to be played as a dress-up doll.

In addition, the slide member 24 is attached to the base portion 22 slidably. That is, when the slide member 24 slides against the base portion 22, the mounting body 20 is transformed with mechanism movement. Accordingly, the structure can be made suitable for a toy for boys such as a transformable robot.

In addition, the arm portions 25 and the front member 26 are urged in the opening direction by the springs, but locked against the urging forces of the springs in the state prior to transformation. When the slide member 24 moves, the arm portions 25 and the front member 26 can be unlocked and transformed. Accordingly, the mounting body 20 can be transformed in a comparatively simple structure.

Second Embodiment

A second embodiment will be described with reference to FIGS. 6 and 7, FIGS. 8A to 8D, and FIGS. 9A and 9B.

Figure 6:
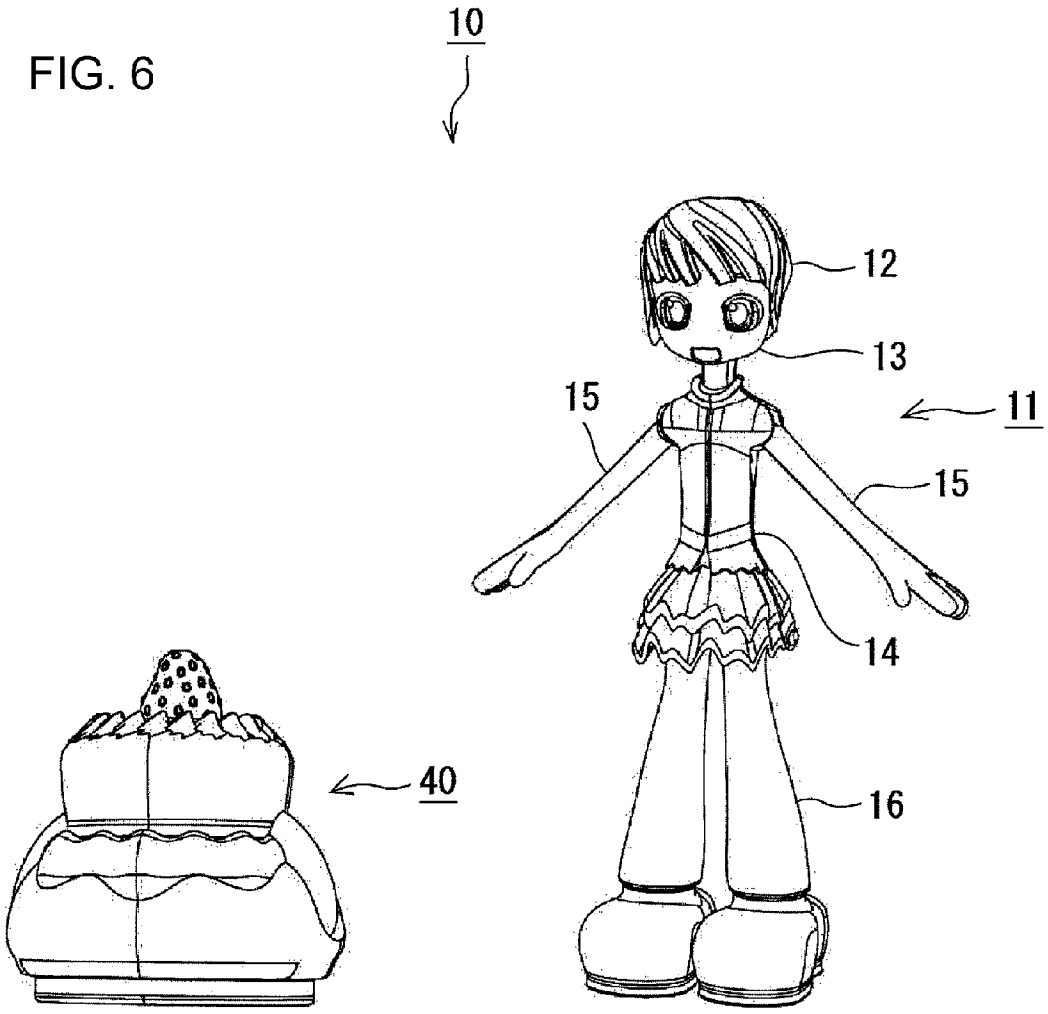
FIG. 6 is an external perspective view of a combinable transformable toy according to a second embodiment.

As shown in FIG. 6, a combinable transformable toy 10 according to the embodiment is configured of a doll body 11 which is the same as that in the first embodiment, and a mounting body 40.

The mounting body 40 according to the embodiment is a member which is formed to be able to be externally mounted on the doll body 11. The mounting body 40 has the following configuration. That is, the mounting body 40 has a form irrelevant to a dress for the doll body 11 before the mounting body 40 is mounted on the doll body 11. However, after the mounting body 40 is mounted on the doll body 11, the mounting body 40 is transformed into the form of a dress for the doll body 11. In the embodiment, the mounting body 40 in the state of not being mounted on the doll body 11 has the form of a cake. Incidentally, the form of the mounting body 40 prior to transformation is not limited to the cake, but can be set as anything.

Figure 7:
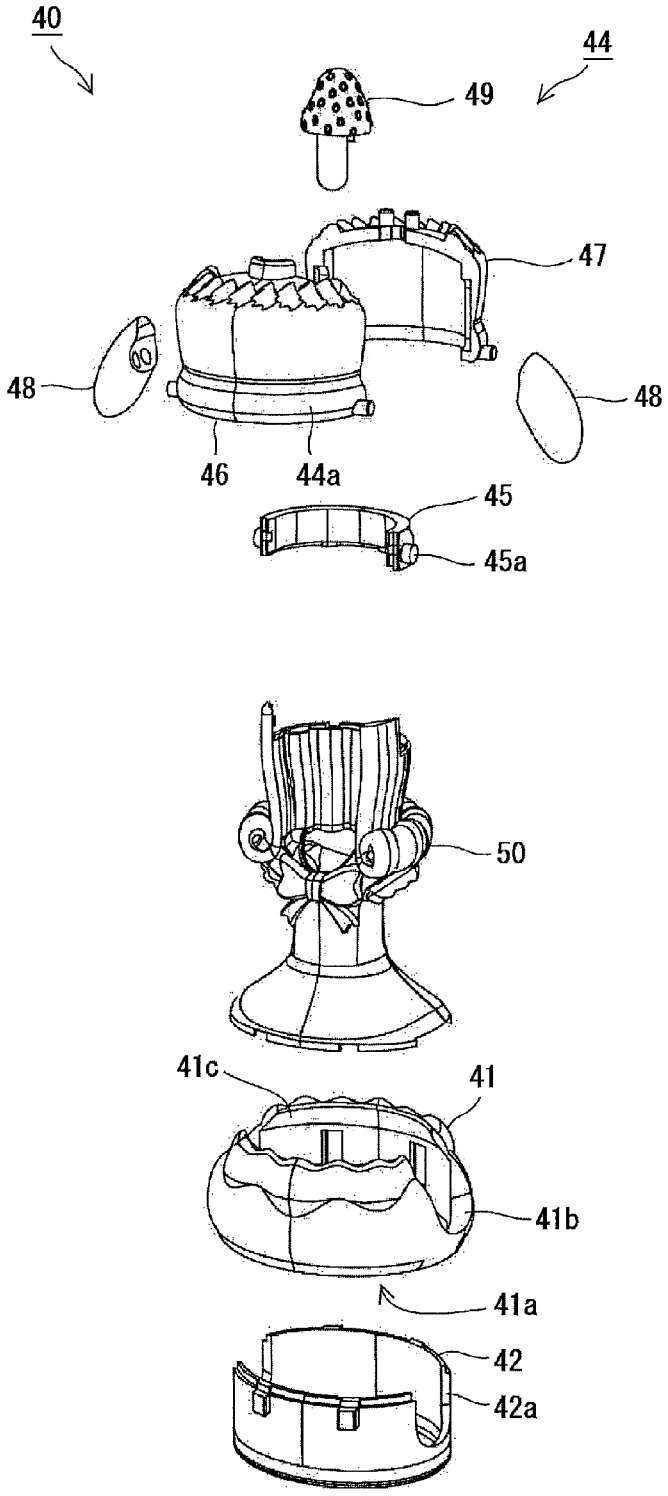
FIG. 7 is an exploded perspective view of a mounting body according to the second embodiment when seen obliquely from the front.

As shown in FIG. 7, the mounting body 40 according to the embodiment is provided with a base portion 41, a movement portion 44 and a transformation portion 50.

The base portion 41 is a portion which covers the vicinities of leg portions 16 of the doll body 11 when the mounting body 40 is mounted on the doll body 11. To mount the mounting body 40 on the doll body 11, the base portion 41 is held by a hand and then put on the doll body 11. In this manner, the mounting body 40 can be mounted on the doll body 11. An insertion port 41*a* into which the doll body 11 can be inserted is opened in the bottom of the base portion 41. In addition, notch portions 41*b* are formed in opposite side portions of the base portion 41 so that arm portions 15 of the doll body 11 can be passed through the notch portions 41*b* when the mounting body 40 is mounted on the doll body 11.

The movement portion 44 is a portion which is attached to the base portion 41 movably. The movement portion 44 according to the embodiment is coupled to the base portion 41 through the transformation portion 50 which will be described later. As shown in FIG. 7, the movement portion 44 is provided with a front cover 46, a rear cover 47, a pair of side covers 48, and a top ornament 49.

The front cover 46 and the rear cover 47 are portions which cover a head portion 12 of the doll body 11 when the front cover 46 and the rear cover 47 are joined and fixed to each other in the front/rear direction. The pair of side covers 48 are attached to opposite sides of the movement portion 44. The pair of side covers 48 serve for covering the notch portions 41*b* of the base portion 41 when the mounting body 40 is in the form of the cake. Each of the side covers 48 according to the embodiment is shaped like an animal ear and also serves as an ornament of the movement portion 44. In addition, the top ornament 49 is an ornament attached to the top portion of the movement portion 44.

Incidentally, the movement portion 44 is provided with a swelling portion 44*a* in an outer circumferential portion of the vicinity of its lower end. The swelling portion 44*a* is engaged with a reduced diameter portion 41*c* of the base portion 41 so that the form of the cake can be maintained (see FIG. 9A).

The transformation portion 50 is a portion which covers the vicinity of a side head portion or the trunk portion 14 of the doll body 11 when the mounting body 40 is mounted on the doll body 11. The transformation portion 50 according to the embodiment is made of a soft material such as rubber so that the transformation portion 50 can be bent and transformed easily. The transformation portion 50 is connected to the base portion 41 in the vicinity of its lower end through an inner cylinder 42. The transformation portion 50 is connected to the movement portion 44 in the vicinity of its upper end through a fixation portion 45.

Incidentally, notch portions 42*a* are provided in side portions of the inner cylinder 42 and in positions corresponding to the notch portions 41*b* of the base portion 41. Slits (not shown) are provided in side portions of the transformation portion 50 so as to extend along the notch portions 42*a* of the inner cylinder 42 or the notch portions 41*b* of the base portion 41.

Figure 9A:
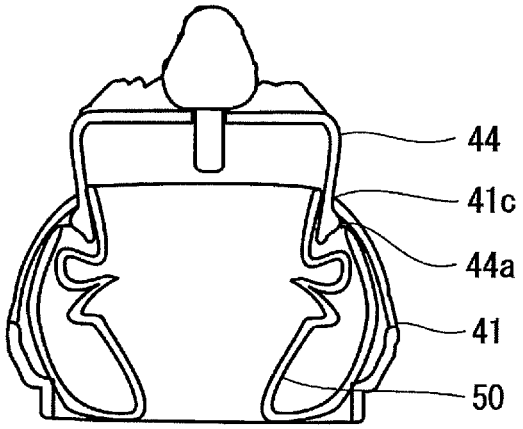
FIGS. 9A and 9B are explanatory views showing the internal structure of the mounting body according to the second embodiment.
Figure 9B:
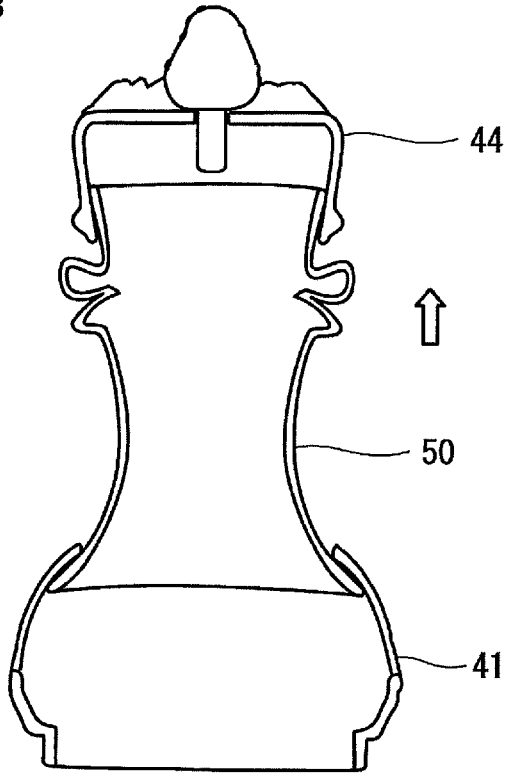

In addition, the fixation member 45 is attached to the movement portion 44 through convex shaft portions 45*a*. The fixation member 45 can swing with respect to the movement portion 44. Incidentally, as shown in FIGS. 9A and 9B, the transformation portion 50 is folded and received inside the base portion 41 or the movement portion 44 in the state of the cake prior to transformation.

Next, motion when the doll body 11 is mounted into the mounting body 40 will be described with reference to FIGS. 8A to 8D.

Figure 8A:
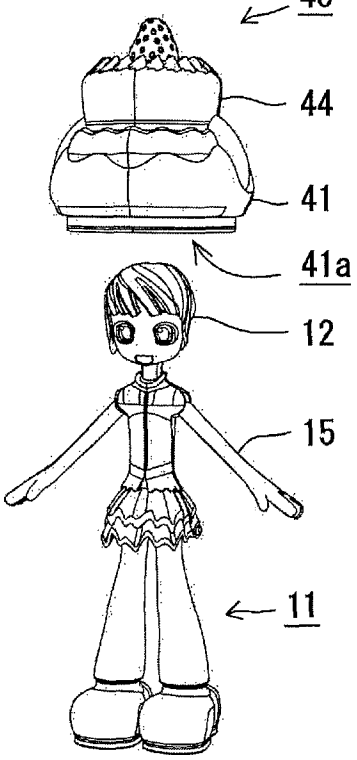
FIGS. 8A to 8D are explanatory views of states in which the mounting body is mounted on a doll toy according to the second embodiment when seen obliquely from the front.
Figure 8B:
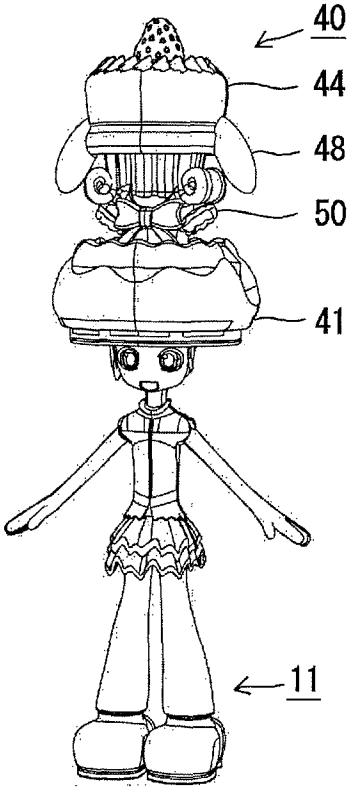

First, as shown in FIGS. 8A to 8B, the head portion 12 of the doll body 11 is inserted from the insertion port 41*a*.

Figure 8C:
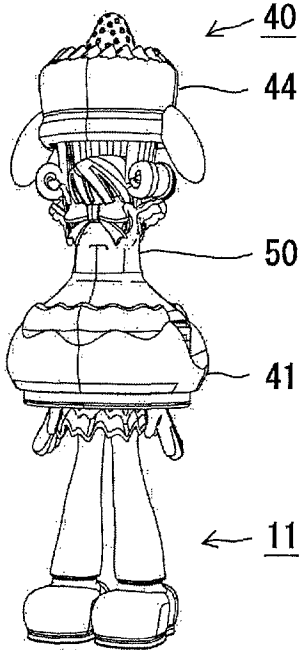

When the head portion 12 of the doll body 11 is inserted into the mounting body 40, the transformation portion 50 and the movement portion 44 are pushed by the doll body 11 so as to move upward together with the doll body 11, as shown in FIG. 8C. When the transformation portion 50 moves upward, the transformation portion 50 folded and received inside the base portion 41 or the movement portion 44 is unfolded so as to be transformed.

Figure 8D:
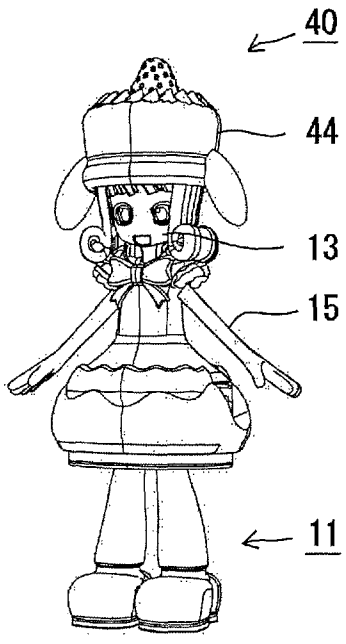

Finally, as shown in FIG. 8D, the mounting body 40 is transformed into the form of a dress to cover the doll body 11. On this occasion, the mounting body 40 covers the doll body 11 while exposing a face 13 of the doll body 11. Incidentally, the arm portions 15 of the doll body 11 stretch out sideways through the slits provided in the side portions of the transformation portion 50 and through the notch portions 41*b* and 42*a*.

Incidentally, to restore the mounting body 40 to the original form of the cake, the doll body 11 is pulled out from the mounting body 40 and then the movement portion 44 is pushed into the base portion 41 so as to engage the swelling portion 44*a* with the reduced diameter portion 41*c*, as shown in FIG. 9A. Incidentally, the notch portions 41*b* are provided in the opening portions of the base portion 41. Accordingly, when the movement portion 44 is pushed into the base portion 41, an end edge of the base portion 41 is expanded elastically so that the swelling portion 44*a* and the reduced diameter portion 41*c* can be engaged with each other resiliently.

According to such an embodiment, when the head portion 12 of the doll body 11 is inserted from the insertion port 41*a* of the mounting body 40, the movement portion 44 of the mounting body 40 is pushed by the doll body 11 to move together with the doll body 11 so that the transformation portion 50 can be transformed in conjunction with the movement of the movement portion 44. That is, when the mounting body 40 is attached to the doll body 11 for playing, not only can the doll body 11 change in appearance but also the mounting body 40 can be transformed in conjunction with the attachment operation. Accordingly, the combinable transformable toy 10 can be made rich in unexpectedness.

In addition, the mounting body 40 covers the doll body 11 while exposing the face 13 of the doll body 11. Accordingly, the combinable transformable toy 10 can be made to provide a way to be played as a dress-up doll.

In addition, the transformation portion 50 is made of the soft material, and folded and received inside the base portion 41 or the movement portion 44 in the state prior to transformation. According to such a configuration, transformation can be completed when the folded transformation portion 50 is simply pulled out. Thus, the structure can be made simple. In addition, the transformation portion 50 is made of the soft material. Accordingly, for example, a soft image can be given to the toy to thereby make it suitable for girls.

What is claimed is:

1. A combinable transformable toy comprising:

a doll body; and a mounting body which can be externally mounted on the doll body; wherein:

the mounting body is provided with a base portion in which an insertion port is opened, a movement portion which is provided to be movable relatively to the base portion, and a transformation portion which is coupled to the movement portion; and when a head portion of the doll body is inserted from the insertion port, the movement portion is pushed by the doll body to move together with the doll body so that the transformation portion can be transformed in conjunction with the movement of the movement portion.

2. A combinable transformable toy according to claim 1, wherein:

the mounting body covers the doll body while exposing a face of the doll body.

3. A combinable transformable toy according to claim 1, wherein:

the movement portion is attached to the base portion slidably.

4. A combinable transformable toy according to claim 1, wherein:

the transformation portion is urged in an opening direction by a spring but locked against urging force of the spring in a state prior to transformation so that when the movement portion moves, the transformation portion can be unlocked and transformed.

5. A combinable transformable toy according to claim 1, wherein:

the transformation portion is made of a soft material, and folded and received inside the base portion or the movement portion in a state prior to transformation.

6. A combinable transformable toy according to claim 2, wherein:

the transformation portion is made of a soft material, and folded and received inside the base portion or the movement portion in a state prior to transformation.

* * * * *